United States Patent [19]

Wilson

[11] 4,157,760

[45] Jun. 12, 1979

[54] EYEGLASS FRAME DISPLAY DEVICE

[75] Inventor: Scott R. Wilson, Milwaukee, Wis.

[73] Assignee: Display Corporation International, Milwaukee, Wis.

[21] Appl. No.: 883,710

[22] Filed: Mar. 6, 1978

[51] Int. Cl.[2] ..... A47F 7/00

[52] U.S. Cl. ..... 211/13; 211/163; 248/DIG. 2

[58] Field of Search ..... 211/13, 60 T, 50, 53, 211/56, 58, 54.1, 57.1, 59.1, 70, 77, 78, 163, 126, 126 (U.S. only); 248/DIG. 2, 458, 415, 131

[56] References Cited

U.S. PATENT DOCUMENTS

| | | | |
|---|---|---|---|
| 2,808,941 | 10/1957 | Foster | 211/13 |
| 3,351,208 | 11/1967 | Siegel | 211/13 |
| 3,352,425 | 11/1967 | Burke | 211/13 |
| 3,891,092 | 6/1975 | Surrette et al. | 211/13 |
| 4,030,608 | 6/1977 | Howard | 211/131 |

FOREIGN PATENT DOCUMENTS

| | | | |
|---|---|---|---|
| 1421487 | 11/1965 | France | 248/DIG. 2 |

*Primary Examiner*—Roy D. Frazier
*Assistant Examiner*—Robert W. Gibson, Jr.

[57] ABSTRACT

A display device for a conventional eyeglass frame includes a display panel and an outer transparent panel mounted on and bowed outwardly relative to the display panel. At least one eyeglass frame can be supported by the device such that the lens holders and bridge of the eyeglass frame are positioned adjacent to the outer transparent panel with the side arms of the eyeglass frame being supportedly received by both the outer transparent panel and the display panel.

13 Claims, 2 Drawing Figures

EYEGLASS FRAME DISPLAY DEVICE

BACKGROUND OF THE INVENTION

1. Field of the Invention

The invention relates to point of purchase display devices and, more particularly, to display devices for conventional eyeglass frames.

2. Description of the Prior Art

Display devices for conventional eyeglass frames are known and disclosed in the following U.S. Pat. Nos: Barnum et al, 3,123,208, Mar. 3, 1964; Leblanc et al, 3,333,708, Aug. 1, 1967; Siegel, 3,351,208, Nov. 7, 1967; Burke, 3,352,425, Nov. 14, 1967; Leblanc et al, 3,357,568, Dec. 12, 1967; Seiller, 3,895,718, July 22, 1975; Dunchock 3,924,750, Dec. 9, 1975.

It is commercially desirable for a display device to support an eyeglass frame in such a manner that the display attracts the attention of a prospective buyer and focuses that person's attention upon the particular style and appearance of the eyeglass frame. In this respect, it is desirable to display the eyeglass frame in a position that simulates the so-called "natural position" of the eyeglass frame when worn by an individual.

Of the prior art patents listed above, Leblanc Aug. 1, 1967), Siegel, Burke, Seiller, and Dunchock all disclose devices which display eyeglass frames in their natural positions. However, all disclose the use of a bridge support member, which detracts from the overall simplicity and attractiveness of the display device.

SUMMARY OF THE INVENTION

One of the objects of this invention is to provide a display device for supporting one or more conventional eyeglass frames in the natural position in a subtle and unobtrusive manner which focuses substantially all of the prospective buyer's attention upon the style and appearance of each eyeglass frame.

Another object of the invention is to provide a display device that supports one or more eyeglass frames in the natural position in a simple and attractive manner.

Yet another object of the invention is to provide a display device that holds one or more eyeglass frames in such a way that it appears as if the eyeglass frames are "floating on air," thereby capturing the attention and curiosity of the prospective buyer while highlighting the style and color of the eyeglass frame. To accomplish these and other objects, the invention provides a display device for a conventional eyeglass frame which includes a pair of lens holders separated by a bridge and a pair of laterally opposed side arms extending rearwardly from the lens holders, each of which side arms includes a temple portion adjacent to the lens holders and a bowed free end portion. The display device comprises a display panel, an outer transparent panel, and mounting means for supporting the outer transparent panel at and bowed outwardly relative to the display panel. The device further includes display means defining outer support means on the outer panel and inner support means on the inner panel. The outer support means receives the side arms of at least one eyeglass frame to position the lens holders and the bridge adjacent to the outer transparent panel. The inner support means is arranged relative to the outer support means to receive and support the side arms adjacent to the bowed free ends thereof.

In its preferred embodiment, the display device includes an upright support frame defining at least two display panels having opposite longitudinal side edges and a plurality of pairs of laterally and vertically spaced inner support apertures located intermediate the opposite longitudinal side edges. The device further includes at least two outer transparent panels, with the number of the outer transparent panels corresponding with the number of the display panels. Each outer transparent panel includes opposite longitudinal edges and a plurality of pairs of laterally and vertically spaced outer support apertures located intermediate the opposite longitudinal edges and corresponding in number with the number of inner support apertures. The Mounting means holds each outer transparent panel, relative to the respective display panel, such that the outer support apertures are in general horizontal and vertical alignment with the inner support apertures. At least one eyeglass frame is displayed with the lens holders and the bridge being held adjacent to the outer transparent panel. This is achieved with the bowed end portions being carried within the inner support apertures and the temple portions being carried within the outer support apertures.

Also in its preferred embodiment, at least two display panels have adjacent long side edges. The display device includes at least one spacer panel having opposite lateral edges and located intermediate the adjacent display panels. The opposite lateral edges form a part of the mounting means for the transparent panel, and the longitudinal edges of the transparent panel abut the lateral edges of the spacer panel. The spacer panel further includes means for mounting both a mirror and advertising copy on the display device.

Other objects and advantages will be pointed out in, or be apparent from, the specification and claims, as will obvious modifications of the embodiment shown in the drawings.

DESCRIPTION OF THE PREFERRED EMBODIMENT

Figure 1:
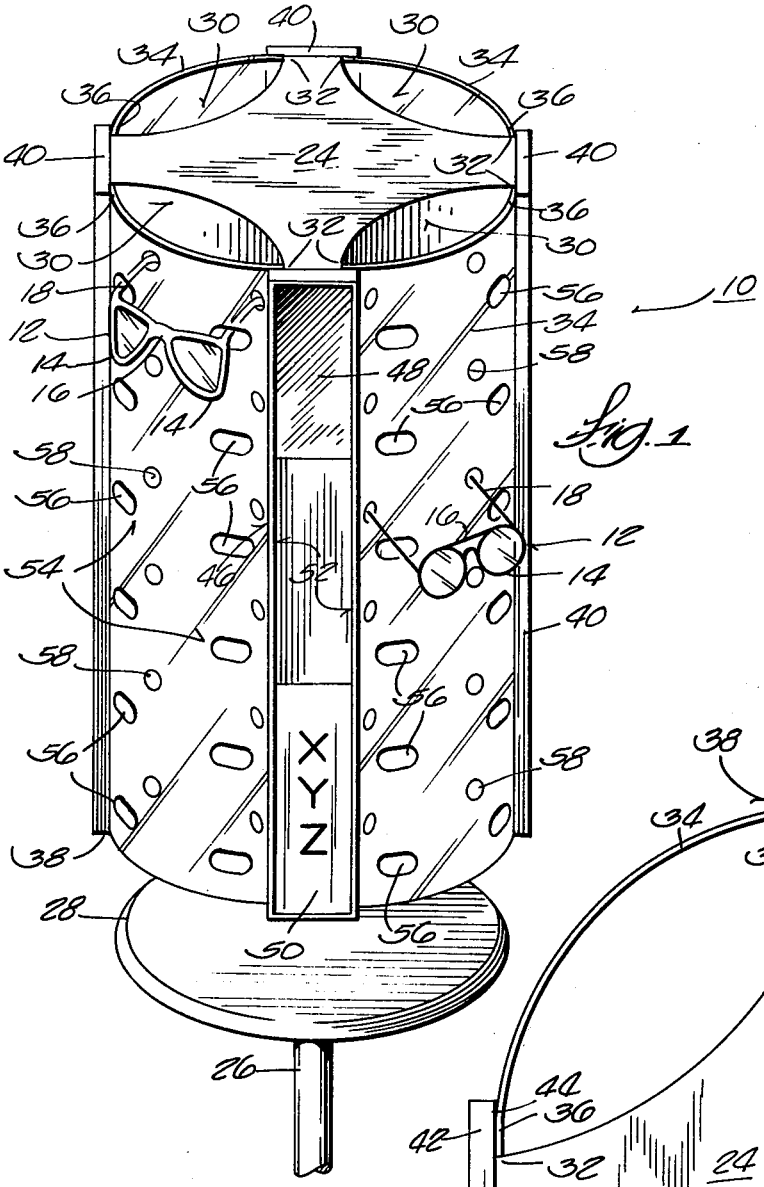
FIG. 1 is a perspective view of a display device which embodies features of the invention.
Figure 2:
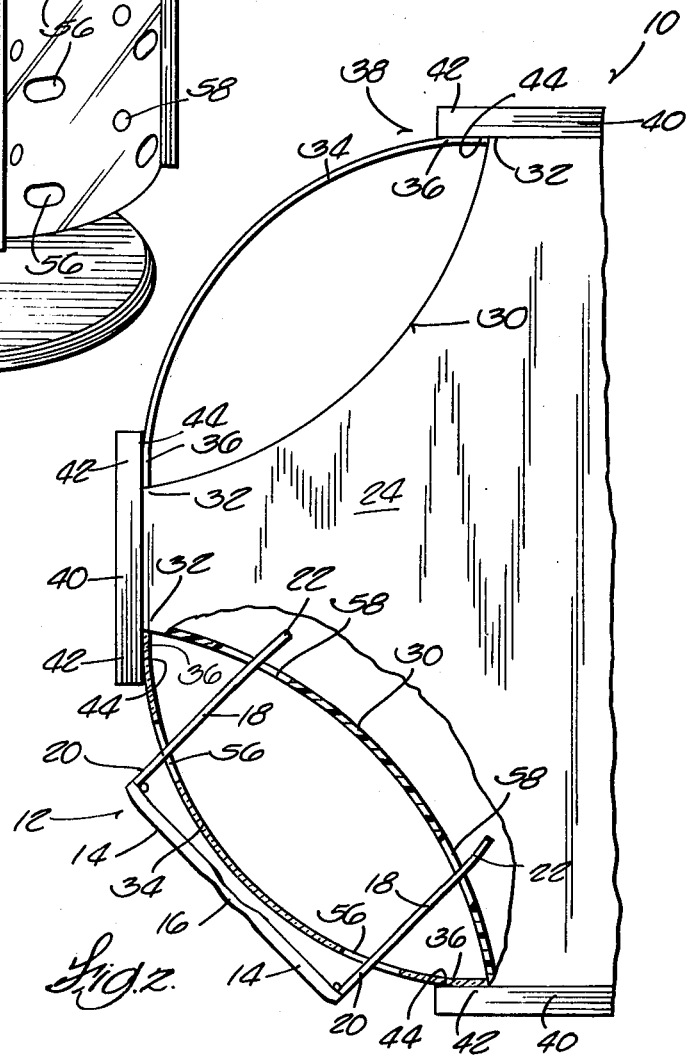
FIG. 2 is a partially fragmentary top view of a portion of the display device illustrated in FIG. 1.

A display device 10 for one or more eyeglass frames 12 is shown in FIG. 1. The eyeglass frame 12 is of a conventional construction and includes a pair of lens holders 14 separated by a bridge 16. The eyeglass frame 12 further includes a pair of laterally opposed side arms 18 extending rearwardly from the lens holder 14. As shown in FIG. 2, each side arm 18 has a temple portion 20 adjacent to the respective lens holder 14 and bowed free end portion 22.

The display device includes an upright support frame 24. The support frame 24 may be mounted on top of a table or store counter (not shown) or, as is shown in FIG. 1, it may be floor mounted on top of a suitable support pole 26 and adapted, if desired, to revolve relative to the support pole 26. Also as illustrated, a frame shelf 28 is provided, upon which a customer may put hand-carried items to free his or her hands to try on the eyeglass frame 12.

The upright support frame 24 defines one or more display panels 30. While the number of display panels 30 can vary, in its illustrated embodiment, four display panels 30 are equally spaced about the perimeter of the support frame 24. Each display panel 30 includes opposite longitudinal side edges 32.

The display panel 30 may be constructed of various materials. It may, for example, be constructed of an opaque material, such as colored plastic. On the other hand, it may be constructed of a transparent or colored translucent material, also such as plastic. In this construction, a light source (not illustrated) may be located within the support frame 24 to illuminate the display panel 30 and thus enhance its display effectiveness. It should be appreciated, however, that the objects of the invention are applicable regardless of the particular construction of the display panel 30.

The device also includes an outer transparent panel 34 having opposite longitudinal edges 36. The number of transparent panels 34 corresponds to the number of display panels 30. Mounting means 38 is provided for supporting each transparent panel 34 at and bowed outwardly relative to its respective display panel 30. While the outer panel 34 may be made from various transparent materials, in the illustrated embodiment, the panel 34 is made of flexible plastic.

Also in the illustrated embodiment, the display panel 30 is of a generally concave shape while the transparent panel 34, when held by the mounting means 38, is convex. In this arrangement, the panels 30 and 34 are of opposite curvature relative to each other. It is to be appreciated, however, that the concave shape is primarily for asthetic purposes, and the object of the invention can be achieved with the display panel 30 having various contours.

Referring now to FIG. 2, the mounting means 38 is located along the opposite longitudinal side edges 32 of each display panel 30. The opposite longitudinal edges 36 of the transparent panel 34 are received behind the mounting means 38. The resiliency of the flexed transparent panel 34 acting against the mounting means 38 holds the transparent panel 34 in place.

While the specific construction of the mounting means 38 can take various forms, in the illustrated embodiment (shown in FIG. 2), it includes a spacer panel 40 located between each of the adjacent display panels 30 and having opposite lateral side edges 42. Preferably, the lateral side edges 42 of each spacer panel 40 are coextensive with the longitudinal edges 32 and 36 of the panels 30 and 34 and extend in a lateral direction beyond the intersection of the spacer panel 40 and each longitudinal side edge 32. A mounting lip 44 is thus formed which runs vertically along each longitudinal side edge 32 and against which the longitudinal edges 36 of each transparent panel 34 abut to hold the transparent panel 34 in place.

Referring now to FIG. 1, the spacer panel 40 includes means 46 for mounting a mirror 48 and advertising copy 50 on the spacer panel. While the means 46 can vary, in the illustrated embodiment, elongated aluminum strips 52 are provided behind which the mirror 48 or the advertising copy 50 can be supported.

One or more eyeglass frames 12 are supported for display on the device 10 by display means 54. As shown in FIG. 1, the display means 54 includes a plurality of laterally and vertically spaced outer support apertures 56 located in panel 34 intermediate its longitudinal edges 36. The display means also includes a plurality of laterally and vertically spaced inner support apertures 58 located in panel 30 intermediate its longitudinal side edges 32. The number of outer support apertures 56 corresponds with the number of inner support apertures 58 and the outer and inner apertures are arranged in aligned pairs.

More particularly, the transparent panel 34 is held by the mounting means 38 relative to the display panel 30 with the outer support apertures 56 in general horizontal and vertical alignment relative to the inner support apertues 58. As shown, in FIG. 2, the side arms 18 of each eyeglass frame 12 are slidably received within both the outer support apertures 56 and the inner support appertures 58. The eyeglass frame 12 is thus displayed with the lens holders 14 and the bridge 16 being held adjacent to the transparent panel 34, the bowed end portions 22 being carried adjacent to and behind the inner support aperture 58, and the temple portions 20 extending through the outer support apperture 56. This securely seats the eyeglass frame 12 in the device 10.

As should now be apparent, because the panel 34 is transparent and bowed outwardly relative to the display panel 30, and the eyeglass frame 12 is held adjacent to the transparent panel 34, it appears as if the eyeglass frame 12 is without support and "floating on air." Only a close examination will reveal the inner and outer support apertures 56 and 58. A unique and attention-commanding effect is thus achieved by the device 10 and the device makes for a very effective point of purchase display.

Although but one embodiment of the present invention has been illustrated and described, it will be apparent to those skilled in the art that various changes and modifications may be made therein without departing from the spirit of the invention or from the scope of the appended claims.

I claim:

1. A display device for a conventional eyeglass frame including a pair of lens holders separated by a bridge and further including a pair of laterally opposed side arms extending rearwardly from said lens holders, said device comprising, a display panel having opposite longitudinal side edges, an outer transparent panel having opposite longitudinal edges, mounting means located along said longitudinal side edges of said display panel for removably receiving said longitudinal edges of said outer transparent panel and for supporting said outer transparent panel on and bowed outwardly relative to said display panel, and display means defining outer support apertures in said transparent panel for receiving said side arms of at least one of said eyeglass frames and to position said pair of lens holders and said bridge adjacent to said outer transparent panel, said display means further including inner support means on said display panel arranged relative to said outer support apertures for engagement with and support of said side arms spaced from said outer transparent panel.

2. A display device for a conventional eyeglass frame including a pair of lens holders separated by a bridge and further including a pair of laterally opposed side arms extending rearwardly from said lens holders, said device comprising, a display panel having opposite longitudinal side edges, an outer transparent panel having opposite longitudinal edges, mounting means for supporting said outer transparent panel at and bowed outwardly relative to said display panel, and display means including a plurality of laterally and vertically spaced outer support apertures located intermediate said longitudinal edges of said outer transparent panel and adapted to receive said side arms of at least one of said eyeglass frames and to position said pair of lens holders and said bridge adjacent to said outer transparent panel, and a plurality of laterally and vertically spaced inner support apertures located intermediate said longitudinal side edges of said display panel and arranged relative to said outer support apertures for engagement with and support of said side arms spaced from said outer transparent panel.

3. A display device according to claim 2 wherein said outer support apertures correspond in number with the number of said inner support apertures.

4. A display device according to claim 2 wherein said mounting means is located along said longitudinal side edges of said display panel and is adapted to removably receive said longitudinal edges of said outer panel.

5. A display device according to claim 3 wherein, said side arms each include a temple portion adjacent to said lens holder and a bowed free end portion spaced from said lens holder, said mounting means is adapted to hold said outer support apertures in general horizontal and vertical alignment relative to said inner support apertures, and at least one of said eyeglass frames is displayed with said bowed free end portions carried within said inner support apertures and said temple portions carried within said outer support apertures.

6. A display device according to claim 1 wherein said display panel is of generally arcuate shape and of opposite curvature relative to the bowed curvature of said outer transparent panel as supported by said mounting means.

7. A display device according to claim 1 wherein said transparent panel is made of a flexible material.

8. A display device according to claim 7 wherein said flexible material is plastic.

9. A display device for a conventional eyeglass frame including a pair of lens holders separated by a bridge and further including a pair of laterally opposed side arms extending rearwardly from said lens holders, each of said side arms having a temple portion adjacent to said lens holder and a bowed free end portion spaced from said lens holder, said display device comprising, an upright support frame including a plurality of display panels each having opposite longitudinal side edges and a plurality of laterally and vertically spaced inner support apertures located intermediate said longitudinal side edges thereof, a plurality of outer transparent panels corresponding in number with the number of said display panels, said outer transparent panels each having opposite longitudinal edges and a plurality of laterally and vertically spaced outer support apertures located intermediate said longitudinal edges thereof and corresponding in number with the number of said inner support apertures, and mounting means for supported said outer transparent panel at and bowed outwardly relative to said display panel and further holding said outer support apertures in general horizontal and vertical alignment relative to said inner support apertures, and wherein at least one of said eyeglass frames is adapted to be displayed with said pair of lens holders and said bridge being adjacent to said outer transparent panel, said bowed free end portions being carried adjacent to said inner support apertures, and said temple portion being carried within said outer support apertures.

10. A display device according to claim 9 further including at least one spacer panel having opposite lateral edges and located intermediate said display panels which are adjacently spaced on said upright support frame, said opposite lateral edges forming a part of said mounting means and engaging said longitudinal edges of said outer transparent panels.

11. A display device according to claim 10 wherein said spacer panel further includes means for mounting both a mirror and advertising copy upon said spacer panel.

12. A display device according to claim 11 wherein said display panel is of generally arcuate shape and of opposite curvature relative to the bowed curvature of said outer transparent panel as supported by said mounting means.

13. A display device according to claim 12, wherein said outer transparent panel is made of a flexible plastic material.

* * * * *